US008118547B1

(12) United States Patent
Liang

(10) Patent No.: US 8,118,547 B1
(45) Date of Patent: Feb. 21, 2012

(54) TURBINE INTER-STAGE GAP COOLING ARRANGEMENT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 562 days.

(21) Appl. No.: 12/423,874

(22) Filed: Apr. 15, 2009

(51) Int. Cl.
*F01D 5/08* (2006.01)

(52) U.S. Cl. ..... 415/173.1; 415/116

(58) Field of Classification Search ..... 415/173.1, 415/116, 199.5, 191, 211.2, 1
See application file for complete search history.

(56) References Cited

U.S. PATENT DOCUMENTS 5,752,802 A * 5/1998 Jones ..... 415/170.1
6,077,035 A * 6/2000 Walters et al. ..... 415/115
7,870,742 B2 * 1/2011 Lee et al. ..... 60/782
2005/0111966 A1 * 5/2005 Metheny ..... 415/116
2007/0059158 A1 * 3/2007 Alvanos et al. ..... 415/115
2008/0112793 A1 * 5/2008 Lee et al. ..... 415/115
2010/0254806 A1 * 10/2010 Deodhar et al. ..... 415/173.7
2011/0129342 A1 * 6/2011 Smoke et al. ..... 416/95

* cited by examiner

*Primary Examiner* — Gary F. Paumen
(74) *Attorney, Agent, or Firm* — John Ryznic

(57) ABSTRACT

A turbine inter-stage gap cooling and sealing arrangement for a turbine in which the blade outer air seal that forms a seal with a stage of rotor blades includes a row of cooling air holes on the back side of the blade outer air seal to discharge cooling air toward a transition between a vane endwall and the vane airfoil such that hot gas flow is not ingested into the gap formed between the BOAS and the vane endwall. The cooling air holes in the BOAS are connected to the impingement cavity on the outer surface of the BOAS to use spent impingement cooling air for discharging toward the inter-stage gap. The BOAS also includes an aft extending ledge that extends toward the vane airfoil in which the cooling air holes are located above.

11 Claims, 3 Drawing Sheets

TURBINE INTER-STAGE GAP COOLING ARRANGEMENT

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine interstage gap between a blade outer air seal and an endwall of an adjacent stator vane.

2. Description of the Related Art Including Information Disclosed Under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

It is well known that the efficiency of the engine can be increased by passing a higher temperature gas flow into the turbine. However, the turbine inlet temperature is limited to the material properties of the turbine parts, such as the first stage guide vanes and rotor blades. Also, the turbine inlet temperature is limited to an amount of cooling that can be produced on a turbine vane or blade. Improved cooling capability will also allow for the turbine airfoils to be exposed to higher temperatures. Improved cooling will also allow for longer part life which results in longer engine run times or longer periods between engine breakdowns.

Another problem with the turbines is hot flow ingestion into a section of the turbine that is sensitive to the high temperatures such as the rim cavities or interstage gaps. Bow wave driven hot gas flow ingestion is created when the hot gas core flow enters a vane row where a leading edge of the vane induces a local blockage and thus creates a circumferential pressure variation at an intersection of the airfoil leading edge location of the vane. The leading edge of a turbine vane generates upstream pressure variations which can lead to hot gas ingress into the front gap. If proper cooling or design measures are not undertaken to prevent this hot gas ingress, exposure to the hot gas can result in severe damage to the front edges of the vane endwall as well as the turbine components located upstream of the endwall. FIG. 1 shows a prior art turbine vane with a bow wave effect located upstream of the turbine vanes. The high pressure upstream of the vane leading edge is greater than the pressure inside the cavity formed by the gap. As a result of the pressure differential, the hot gas will flow radially inward into the cavity. The ingested hot gas flows through the gap circumferentially inside the cavity towards the lower pressure zones. The hot gas then flows out at locations where the cavity pressure is higher than the local hot gas pressure.

FIG. 2 shows a prior art turbine with a first stage rotor blade located upstream from a row of second stage stator vanes. An interstage gap is formed between a blade ring for the rotor blade and a blade ring for the stator vane. This arrangement in FIG. 2 includes a rotor blade 27 with a tip that forms a seal with a blade outer air seal (or BOAS) 24, the BOAS 24 is supported by hooks on an isolation ring 22 on a forward side and a blade ring 21 on an isolation ring 25 on the aft side. A first blade ring 21 supports both isolation rings 22 and 25 and includes a cooling air passage that delivers cooling air to an impingement plate 23 that includes impingement holes 28 that discharge jets of impingement cooling air onto a top surface of the BOAS.

An adjacent stator vane assembly includes a second blade ring 26 that supports a guide vane 11 with an outer endwall 12. an interstage gap 29 is formed between the isolation ring 25 and the vane outer diameter endwall 12 in which the hot gas ingress can occur due to the pressure differential described above.

In general, the size of the bow wave is a strong function of the vane leading edge diameter and distance of the vane leading edge to the endwall edge. The pressure variation in the tangential direction with the gap is sinusoidal. The amount of hot gas flow penetrating the axial gap increases linearly with the increasing axial gap width. It is therefore necessary to reduce the axial gap width to a minimum allowable by tolerance limits in order to reduce the hot gas ingress.

As a result of the design of FIG. 2, hot gas flows in and out along the inter-stage gaps and an over-temperature occurs at the blade outer air seal edges and the blade isolation ring corresponding to the hot gas injection location. This over-temperature issue is more pronounced when an insufficient amount of inter-stage gap purge air for the axial gap is available when a strong bow wave is induced by the low solidity vane airfoil creates a high circumferential pressure variation which acts to push the mainstream hot gas into the inter-stage gap 29.

BRIEF SUMMARY OF THE INVENTION

It is an object of the present invention to provide for a turbine with an interstage gap in which the hot gas ingress into the gap is eliminated.

It is another object of the present invention to eliminate the ingress of hot gas flow caused by a differential pressure between the hot gas pressure and the cavity pressure from the bow-wave effect.

These objectives and more can be achieved by the turbine inter-stage gap cooling apparatus and method of the present invention. A row of cooling air holes are located on the BOAS upstream from the vane leading edge diameter that discharges cooling air into the airfoil leading edge section. The forced injection of the cooling air flow with the use of the blade outer air seal spent cooling air into the transition space between the vane leading edge airfoil and the vane outer diameter endwall will prevent the hot gas flow from ingesting into the interstage gap.

DETAILED DESCRIPTION OF THE INVENTION

Figure 1:
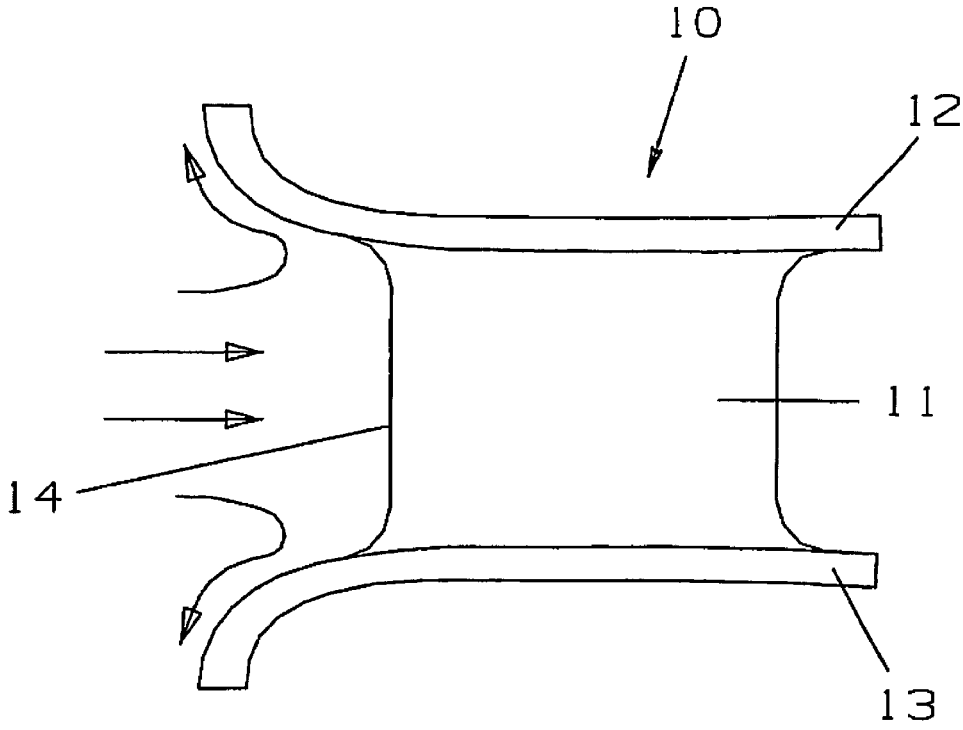
Fig 1 Prior Art
FIG. 1 shows a cross section side view of a prior art turbine stator vane with the hot gas flow pattern and hot gas ingress flow into the outer diameter endwall and inner diameter endwall of the vane.
Figure 2:
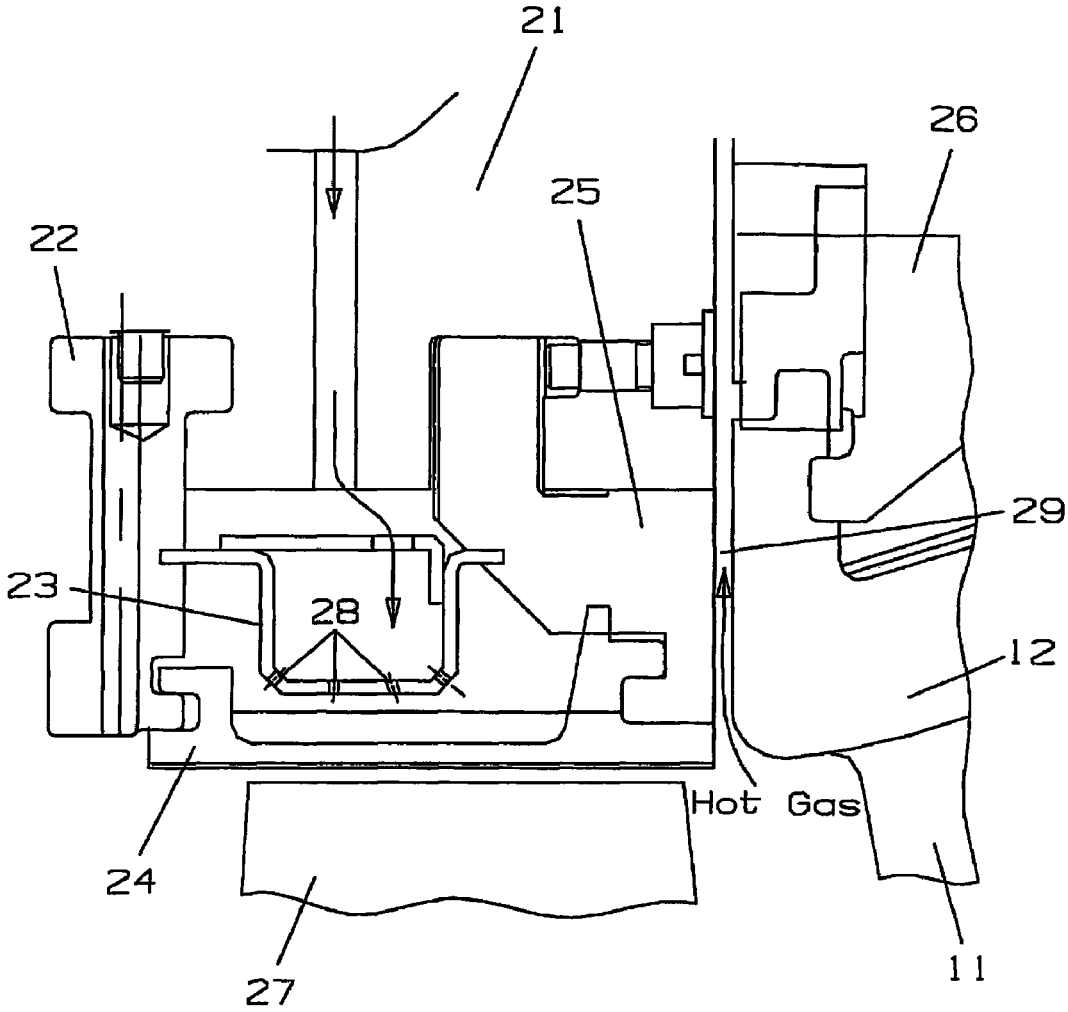
Fig 2 Prior Art
FIG. 2 shows a cross section side view of an inter-stage seal arrangement for a prior art turbine rotor blade and adjacent stator vane design with an interstage gap.
Figure 3:
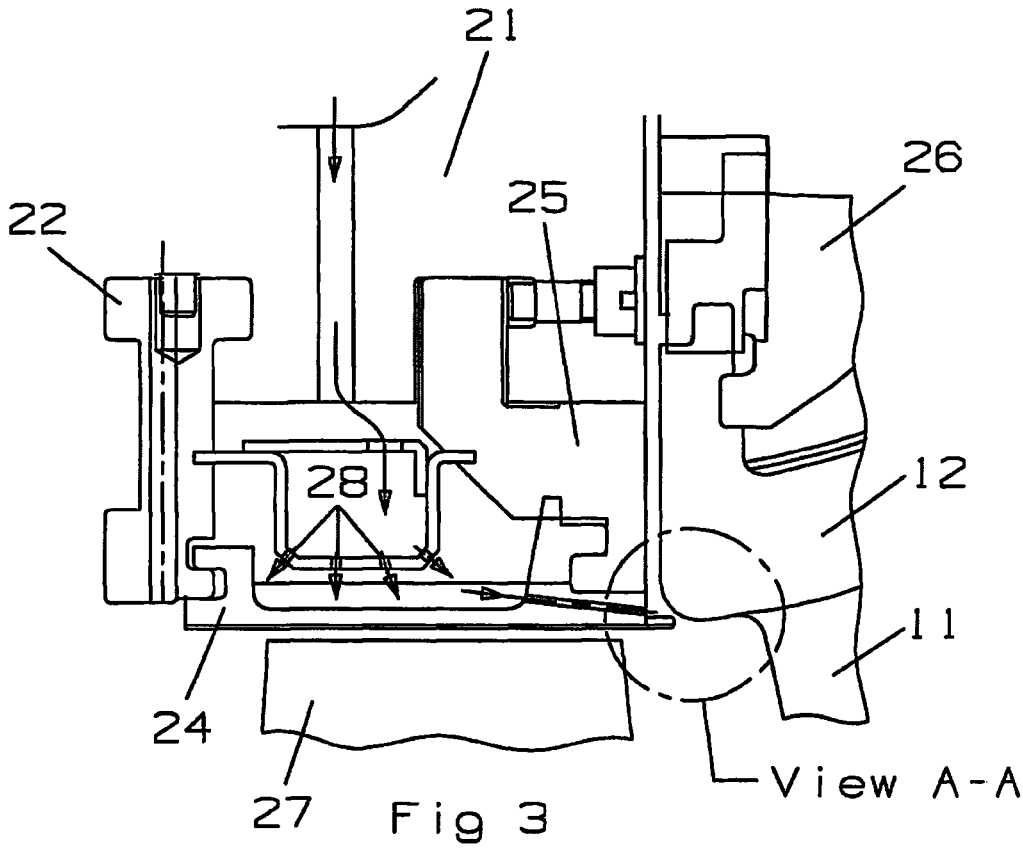
FIG. 3 shows a cross section side view of an inter-stage seal arrangement of the present invention for the turbine rotor blade and adjacent stator vane with an inter-stage gap.
Figure 4:
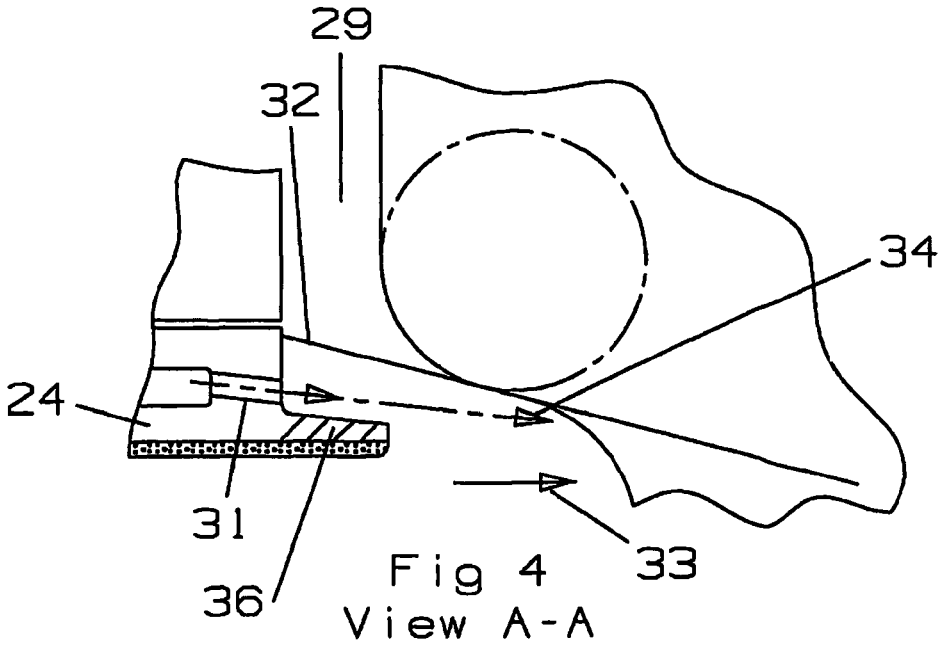
FIG. 4 shows a detailed close-up view of the BOAS cooling air holes for the gap of FIG. 3.

The present invention is a turbine interstage gap cooling apparatus and method for an industrial gas turbine engine that can also be used in an aero engine for the same purpose. FIG. 3 shows a stage of rotor blades adjacent to an upstream from a stage of guide vanes. The rotor blade 27 includes a tip that forms a seal with the BOAS 24 as in the prior art FIG. 2. The same parts in FIG. 3 are labeled as the same reference numbers as in the prior art FIG. 2 arrangement. The blade outer air seal (BOAS) 24 in the FIG. 3 invention includes a row of cooling air holes 31 as seen in FIG. 4 that connect the inner side of the BOAS to the aft side of the BOAS 24 such that spent impingement cooling air from the inner surface of the BOAS 24 will be discharged in the direction of the arrow shown in FIG. 4. The BOAS 24 includes an outward extending ledge 36 on the aft side that extends beyond the plane of the aft side that is flush with the isolation ring 25 as is the case in the prior art FIG. 2 BOAS. The cooling air holes 31 are located above the ledge 36 and are directed to discharge the cooling air toward the transition between the concave shaped outer diameter endwall 12 and the leading edge of the airfoil 11. The cooling air holes 31 extend along the aft side of the BOAS. A TBC is shown applied to the inner surface of the BOAS. A tangent line 32 is tangent to the concave shaped endwall surface as seen in FIG. 4. An arrow 33 represents the direction of the hot gas flow through the vane. The angle of the cooling air holes 31 and therefore the angle of injection of the cooling air 34 is half the difference between the two angles of the tangent 32 and the hot gas flow 33.

The injection of the spent cooling air from the blade outer air seal trailing edge cooling through the row of metering holes 31 and into the vane leading edge nose region will eliminate the hot gas ingestion into the gap 29 that is present in the prior art inter-stage seal gap design. The spent cooling air form the blade outer air seal is discharged into the vane leading edge in-between the angle formed by the streamline of the hot gas flow and a tangent to the endwall corner diameter of the vane. This precise position of the spent cooling air discharge cooling holes 31 will provide proper cooling for the vane bow wave region in addition to prevent ingress of the hot gas into the gap 29.

I claim the following:

1. A gas turbine engine comprising:

a blade outer air seal that forms a seal with a stage or rotor blades;

a stator vane located adjacent to and downstream from the stage of rotor blades;

the stator vane having a vane airfoil extending from an outer diameter endwall;

a turbine inter-stage gap formed between the blade outer air seal and the vane outer diameter endwall in which a hot gas flow from the turbine can be ingested into; and, a row of cooling air holes in the blade outer air seal directed to discharge cooling air at a location upstream from the inter-stage gap to prevent ingestion of the hot gas flow from the turbine.

2. The gas turbine engine of claim 1, and further comprising:

the vane endwall has a concave curvature that forms a tangent line;

the hot gas flow passes through the turbine in a specific direction; and, the cooling holes in the blade outer air seal are angled at around one half a difference between the tangent line and the hot gas flow specific direction.

3. The gas turbine engine of claim 1, and further comprising:

the blade outer air seal includes a ledge on the aft side that extends toward the vane airfoil; and, the cooling air holes discharge the cooling air above the ledge.

4. The gas turbine engine of claim 1, and further comprising:

the cooling air holes extend along from one side of the back side to the opposite side of the back side of the blade outer air seal.

5. The gas turbine engine of claim 1, and further comprising:

the cooling air holes open into the inner surface of the blade outer air seal such that spent impingement cooling air for the blade outer air seal flows through the cooling air holes.

6. A blade outer air seal used for form a seal between a turbine rotor blade in a gas turbine engine, the blade outer air seal comprising:

an inner surface that forms a gap with a blade tip of a turbine rotor blade;

a forward hook that secures a forward side of the blade outer air seal to a first isolation ring;

an aft hook that secures an aft side of the blade outer air seal to a second isolation ring;

an impingement cavity formed on the outer side of the blade outer air seal; and, a row of cooling air holes that open onto a backside of the blade outer air seal and air connected to the impingement cavity.

7. The blade outer air seal of claim 6, and further comprising:

a ledge extending out from a backside of the blade outer air seal and being flush with the inner surface; and, the row of cooling air holes opening above the ledge.

8. The blade outer air seal of claim 6, and further comprising:

the row of cooling air holes discharging cooling air at an angle slightly downward in a direction of a rotational axis of the rotor blades.

9. The blade outer air seal of claim 6, and further comprising:

the row of cooling air holes is angled to discharge jets of cooling air toward a transition between a vane endwall and an airfoil extending from the vane endwall.

10. A process for reducing an ingestion of a hot gas flow into an interstage gap formed between a stage of rotor blades and an adjacent stage of stator vanes within a gas turbine engine, the process comprising the steps of:

Impinging cooling air onto a backside surface of a blade outer air seal that forms a seal with the stage of rotor blades; and, Discharging spent impingement cooling air from the blade outer air seal toward an upstream end of the interstage gap to prevent a hot gas flow from ingesting into the gap.

11. The process for reducing an ingestion of a hot gas flow into an interstage gap of claim 10, and further comprising the step of:

Forming a ledge on the aft side of the blade outer air seal that extends toward the vane airfoil and is located below the discharge of the spent cooling air.

* * * * *